US009999333B2

(12) United States Patent
Thorne et al.

(10) Patent No.: US 9,999,333 B2
(45) Date of Patent: Jun. 19, 2018

(54) FLOOR CLEANING APPLIANCE

(71) Applicant: SharkNinja Operating LLC, Newton, MA (US)

(72) Inventors: Jason Boyd Thorne, Wellesley Hills, MA (US); Kai Xu, Suzhou (CN)

(73) Assignee: SharkNinja Operating LLC, Needham, MA (US)

( * ) Notice: Subject to any disclaimer, the term of this patent is extended or adjusted under 35 U.S.C. 154(b) by 384 days.

(21) Appl. No.: 14/659,048

(22) Filed: Mar. 16, 2015

(65) Prior Publication Data

US 2015/0183108 A1 Jul. 2, 2015

Related U.S. Application Data

(62) Division of application No. 13/783,229, filed on Mar. 1, 2013, now Pat. No. 9,060,665.

(51) Int. Cl.
*A47L 9/28* (2006.01)
*A47L 9/32* (2006.01)
(Continued)

(52) U.S. Cl.
CPC ..... *A47L 11/4008* (2013.01); *A47L 5/28* (2013.01); *A47L 9/0009* (2013.01); *A47L 9/28* (2013.01);
(Continued)

(58) Field of Classification Search
CPC ..... A47L 9/28; A47L 9/2836; A47L 9/2842; A47L 9/2847; A47L 9/2857; A47L 9/2863; A47L 9/32; A47L 9/325; A47L 11/40; A47L 11/4002; A47L 11/4008; A47L 11/4011; A47L 11/4075; A47L 13/225; Y10S 15/10
(Continued)

(56) References Cited

U.S. PATENT DOCUMENTS 1,146,668 A 7/1915 Tanaka
1,356,663 A * 10/1920 Spielman ..... H01H 35/00 15/DIG. 10
(Continued)

FOREIGN PATENT DOCUMENTS

DE 3 634 056 C1 1/1988
DE 3803257 A1 8/1989
(Continued)

OTHER PUBLICATIONS

PCT Search Report and Written Opinion dated Jun. 26, 2014, received in PCT Application No. PCT/US14/19250, 15 pgs.
(Continued)

*Primary Examiner* — Mark Spisich
(74) *Attorney, Agent, or Firm* — Grossman Tucker Perreault & Pfleger, PLLC

(57) ABSTRACT

A pivoting and swiveling floor treatment appliance includes a lock-prevention member that prevents a body from becoming pivotally locked in a forward/backward direction when a portion of the body is in a swiveled position. The lock-prevention member may move relative to an appliance head and to a portion of the body that swivels. In some embodiments, components of the lock-prevention member contribute to locking the swivel of the body when the body is pivotally locked.

14 Claims, 11 Drawing Sheets

(51) Int. Cl.

| | |
|---|---|
| ***A47L 11/40*** | (2006.01) |
| ***A47L 13/24*** | (2006.01) |
| ***B25G 3/38*** | (2006.01) |
| ***A47L 5/28*** | (2006.01) |
| ***A47L 9/00*** | (2006.01) |

(52) U.S. Cl.

CPC ..... *A47L 9/2836* (2013.01); *A47L 9/2863* (2013.01); *A47L 9/32* (2013.01); *A47L 9/325* (2013.01); *A47L 11/4075* (2013.01); *A47L 11/4091* (2013.01); *A47L 13/24* (2013.01); *B25G 3/38* (2013.01); *Y10S 15/10* (2013.01)

(58) Field of Classification Search

USPC ..... 15/49.1, 50.1, 50.2, 52.2, 98, 319, 410, 15/411, DIG. 10; 451/350, 351, 353

See application file for complete search history.

(56) References Cited

U.S. PATENT DOCUMENTS 1,380,163 A * 5/1921 Spielman ..... A47L 9/2842 15/410
1,420,180 A 6/1922 Casmire
1,447,814 A * 3/1923 Paulus ..... A47L 9/2842 15/410
1,643,637 A 9/1927 Chadwick
1,864,886 A 6/1932 Bihler
1,969,036 A 8/1934 Frederick
2,013,963 A 9/1935 Ingling
2,041,748 A * 5/1936 Engberg et al. .... A47L 11/4005 15/49.1
2,328,613 A 9/1943 Burleigh
2,500,840 A 3/1950 Lyons et al.
2,534,479 A * 12/1950 Sellers ..... A47L 5/30 15/319
2,672,642 A 3/1954 Tamarin et al.
2,750,618 A * 6/1956 Kaufman ..... A47L 9/2842 15/410
2,796,621 A 6/1957 Legge
2,802,230 A 8/1957 Maddox
2,806,242 A 9/1957 Sparklin
2,875,460 A 3/1959 Legge
2,893,035 A 7/1959 Weaver et al.
2,926,370 A 3/1960 Wessel
2,929,087 A 3/1960 Salmon
3,006,668 A 10/1961 Stewart
3,066,344 A 12/1962 Borras et al.
3,099,028 A * 7/1963 Ardito ..... A47L 11/1625 15/50.1
3,103,028 A 9/1963 Richards
3,159,726 A * 12/1964 Helm ..... A47L 9/2842 200/332.2
3,216,047 A * 11/1965 Ernolf ..... A47L 11/16 15/385
3,217,351 A * 11/1965 Hayba ..... A47L 5/30 15/324
3,236,985 A * 2/1966 Ernolf ..... H01H 9/06 15/49.1
D206,748 S 1/1967 Mabie et al.
3,528,120 A 9/1970 Lindstrom
3,593,359 A 7/1971 Strauss
3,737,938 A 6/1973 Saltzstein
3,792,505 A 2/1974 Saltzstein
3,797,064 A 3/1974 MacFarland
3,932,912 A 1/1976 Johnson
3,992,747 A 11/1976 Hufton
D245,473 S 8/1977 Heninger
4,129,920 A 12/1978 Evans et al.
4,321,095 A 3/1982 Argo et al.
4,423,534 A 1/1984 Lyman et al.
D290,144 S 6/1987 Bruce
4,685,167 A 8/1987 Murray
4,802,782 A 2/1989 Scalf
D302,058 S 7/1989 Brooks
4,893,370 A 1/1990 Klotz
4,951,341 A 8/1990 Shears
5,025,596 A 6/1991 Heyer et al.
5,071,489 A 12/1991 Silvenis et al.
5,177,831 A 1/1993 Wirth
5,293,660 A 3/1994 Park
5,323,510 A 6/1994 Redding et al.
5,377,378 A 1/1995 Cutler
5,381,577 A 1/1995 Lilja
5,392,491 A 2/1995 Hwang et al.
D358,238 S 5/1995 Barnett
5,419,015 A 5/1995 Garcia
5,511,271 A 4/1996 Shishido et al.
5,584,095 A 12/1996 Redding et al.
5,617,611 A 4/1997 Worwag
D384,209 S 9/1997 Driggers
D391,715 S 3/1998 Irwin et al.
5,794,305 A 8/1998 Weger
5,867,860 A 2/1999 Harris
D406,424 S 3/1999 Daniels
6,003,191 A 12/1999 Sherry et al.
D426,039 S 5/2000 Tintelnot et al.
6,055,703 A 5/2000 Redding et al.
6,101,661 A 8/2000 Policicchio et al.
6,148,473 A 11/2000 Embree et al.
D435,948 S 1/2001 Long
6,277,164 B1 8/2001 Embree et al.
6,289,551 B1 9/2001 Basile
6,308,366 B1 10/2001 Hays
D471,334 S 3/2003 Reede
6,606,757 B2 8/2003 Vosbikian et al.
6,651,290 B2 11/2003 Kingry et al.
6,766,552 B1 7/2004 Policicchio et al.
7,155,768 B2 1/2007 Morita et al.
7,159,277 B2 1/2007 Steiner et al.
D536,176 S 2/2007 Ramirez
D556,260 S 11/2007 Starr
D560,868 S 1/2008 So
7,350,266 B2 4/2008 Park et al.
7,356,876 B2 4/2008 Dant et al.
7,383,608 B2 6/2008 Odachi et al.
D575,918 S 8/2008 Rosenzweig et al.
7,503,098 B2 3/2009 Stein
7,516,508 B2 4/2009 Stackpole, Jr. et al.
7,581,284 B2 9/2009 Courtney
7,581,285 B2 9/2009 Courtney
7,600,292 B2 10/2009 Courtney
7,607,196 B2 10/2009 Li
7,610,653 B2 11/2009 Courtney
7,690,069 B2 4/2010 Chen et al.
D626,302 S 10/2010 Kaminer et al.
7,805,804 B2 10/2010 Loebig
D626,711 S 11/2010 Kaminer et al.
D642,759 S 8/2011 Otsuka et al.
8,011,060 B2 9/2011 Liebig et al.
8,032,981 B2 10/2011 Yoo
8,082,624 B2 12/2011 Myers
D653,070 S 1/2012 Powell
8,122,555 B2 2/2012 Kim
8,151,408 B2 4/2012 Finke et al.
8,181,309 B2 5/2012 Mersmann et al.
8,186,007 B2 5/2012 Iseringhausen et al.
8,201,296 B2 6/2012 Mayer
8,201,302 B2 6/2012 Poetting
8,220,103 B1 7/2012 Lewis
8,250,700 B2 8/2012 Pung et al.
8,261,402 B2 9/2012 Rosenzweig et al.
8,272,097 B2 9/2012 Poetting
D669,648 S 10/2012 Bilger et al.
8,332,987 B2 12/2012 Kaminer et al.
D674,640 S 1/2013 Knoll
8,353,074 B2 1/2013 Krebs
8,365,447 B2 2/2013 Rosenzweig et al.
D685,544 S 7/2013 Clarke
8,500,211 B2 8/2013 Lindblad
8,505,551 B2 8/2013 Moretti
D692,631 S 10/2013 Pung et al.
D716,512 S 10/2014 Layevsky

(56) References Cited

U.S. PATENT DOCUMENTS

| | | | |
|---|---|---|---|
| D724,349 | S | 3/2015 | Jalbert et al. |
| 2003/0009839 | A1 | 1/2003 | Streutker et al. |
| 2003/0044569 | A1 | 3/2003 | Kacher et al. |
| 2003/0131440 | A1 | 7/2003 | Illingworth |
| 2003/0172480 | A1 | 9/2003 | Ueda et al. |
| 2003/0180083 | A1 | 9/2003 | Hall et al. |
| 2003/0209263 | A1 | 11/2003 | Bell et al. |
| 2004/0074520 | A1 | 4/2004 | Truong et al. |
| 2004/0237228 | A1* | 12/2004 | King ..... A47L 11/03 15/50.1 |
| 2004/0255411 | A1 | 12/2004 | Grey |
| 2005/0081888 | A1 | 4/2005 | Pung et al. |
| 2006/0000041 | A1 | 1/2006 | Streutker et al. |
| 2006/0080803 | A1 | 4/2006 | Stein |
| 2006/0191557 | A1 | 8/2006 | Rosenzweig et al. |
| 2006/0200927 | A1 | 9/2006 | Kacher et al. |
| 2007/0022555 | A1 | 2/2007 | Penzes |
| 2007/0061987 | A1 | 3/2007 | Kresse et al. |
| 2007/0074366 | A1 | 4/2007 | Glaug et al. |
| 2007/0107151 | A1 | 5/2007 | Pung et al. |
| 2008/0038045 | A1 | 2/2008 | Hofte et al. |
| 2008/0141472 | A1 | 6/2008 | Jeutter et al. |
| 2008/0145593 | A1 | 6/2008 | Tsai |
| 2009/0056057 | A1 | 3/2009 | Poetting |
| 2009/0056058 | A1 | 3/2009 | Finke et al. |
| 2009/0056059 | A1 | 3/2009 | Mersmann et al. |
| 2009/0056063 | A1 | 3/2009 | Poetting |
| 2009/0056068 | A1 | 3/2009 | Iseringhausen et al. |
| 2009/0158544 | A1 | 6/2009 | Pagani |
| 2010/0147329 | A1 | 6/2010 | Leymonerie |
| 2010/0263152 | A1 | 10/2010 | Wildeman |
| 2011/0023256 | A1 | 2/2011 | Conrad |
| 2011/0131742 | A1 | 6/2011 | Cheung |
| 2011/0265227 | A1 | 10/2011 | Shih et al. |
| 2012/0023693 | A1 | 2/2012 | Pung et al. |
| 2012/0042462 | A1 | 2/2012 | Milanese et al. |
| 2012/0090131 | A1 | 4/2012 | Woerwag |
| 2012/0151703 | A1 | 6/2012 | Chow |
| 2012/0216364 | A1 | 8/2012 | Muhlenkamp |
| 2014/0245551 | A1 | 9/2014 | Jalbert et al. |
| 2014/0245554 | A1 | 9/2014 | Kaminer et al. |
| 2014/0245555 | A1 | 9/2014 | Thorne et al. |
| 2014/0245556 | A1 | 9/2014 | Kaminer et al. |
| 2014/0246048 | A1 | 9/2014 | Jalbert et al. |

FOREIGN PATENT DOCUMENTS

| | | | |
|---|---|---|---|
| EP | 0 430 846 | A1 | 6/1991 |
| EP | 1 935 575 | A1 | 6/2008 |
| EP | 2 213 424 | A2 | 8/2010 |
| GB | 399174 | | 9/1933 |
| GB | 473362 | | 10/1937 |
| GB | 1023556 | | 3/1966 |
| GB | 1305166 | * | 1/1973 |
| JP | 2006081691 | A | 3/2006 |
| JP | 2012066024 | A | 4/2012 |
| KR | 200299096 | Y1 | 1/2003 |
| WO | 2008130163 | A1 | 10/2008 |

OTHER PUBLICATIONS

PCT Search Report and Written Opinion dated Jun. 17, 2014, received in PCT Application No. PCT/US14/19253, 12 pgs.

PCT Search Report and Written Opinion dated Jun. 25, 2014, received in PCT Application No. PCT/US14/19255, 10 pgs.

* cited by examiner

FLOOR CLEANING APPLIANCE

RELATED APPLICATIONS

This application is a divisional of, and claims the benefit of, U.S. application Ser. No. 13/783,229, entitled "FLOOR CLEANING APPLIANCE" and filed Mar. 1, 2013 now U.S. Pat. No. 9,060,665, which is herein incorporated by reference in its entirety.

FIELD

The invention relates generally to surface treatment appliances, and more specifically to appliances which have a body that swivels and pivots relative to an appliance head.

DISCUSSION OF THE RELATED ART

Surface treatment appliances are used in the home, office and other locations to treat floors and other surfaces. Various types of surface treatment appliances are known, including steam mops, vacuum cleaners and floor polishers, for example. Some floor treatment appliances have a body that both pivots and swivels relative to an appliance head to facilitate steering of the appliance.

SUMMARY

According to one embodiment, a floor treatment appliance includes an appliance head to treat a floor surface and a body pivotally connected to the appliance head, the body being pivotable between a use position and a locked position in which the body portion is lockable against pivoting. The body includes a swivel joint that allows at least a portion of the body to swivel relative to the appliance head between at least a home swivel position and a non-home swivel position. The body includes a moveable lock-prevention member which prevents the body from becoming pivotally locked in the locked position when the body is in the non-home swivel position, and permits the body to become pivotally locked in the locked position when the body is in the home swivel position, the moveable lock-prevention member being moveable relative to the portion of the body that swivels relative to the appliance head, and the lock prevention member being moveable relative to the appliance head.

In one embodiment, a floor treatment appliance includes an appliance head to treat a floor surface and a body pivotally connected to the appliance head, the body being pivotable between a use position and a locked position in which the body portion is lockable against pivoting. The body portion includes a swivel joint that allows at least a portion of the body to swivel relative to the appliance head between at least a home swivel position and a non-home swivel position and includes a movable lock-prevention member which prevents the body from becoming pivotally locked in the locked position when the body is in the non-home swivel position, and permits the body to become pivotally locked in the locked position when the body is in the home swivel position. When the body is pivoted to the locked position, the lock-prevention member prevents the body from swiveling by moving across the swivel joint to interlock the upper portion of the body to the lower portion.

In still another embodiment, a floor treatment appliance includes an appliance head to treat a floor surface and a body pivotally connected to the appliance head, the body being pivotable between a use position and a pivotally-locked storage position. The body includes a swivel joint that allows an upper portion of the body to swivel relative to a lower portion of the body between at least a home swivel position and a non-home swivel position and includes a moveable swivel-prevention member that prevents swiveling of the upper body portion by interlocking the upper and lower body portions across the swivel joint whenever the body is brought to the pivotally-locked storage position.

In yet another embodiment, a floor treatment appliance includes an appliance head to treat a floor surface, a body pivotally connected to the appliance head, the body being pivotable between a use position and a locked position in which the body is pivotally lockable, the body including a swivel joint that allows a portion of the body to swivel relative to the appliance head between at least a home swivel position and a non-home swivel position, and a sensor component that prompts a stopping of operation of at least a portion of the appliance when the body is brought to the locked position with the body in the home swivel position. The sensor does not prompt a stopping of operation of at least a portion of the appliance when the body is pivoted as far forward as possible with the body in the non-home swivel position.

It should be appreciated that the foregoing concepts, and additional concepts discussed below, may be arranged in any suitable combination, as the present disclosure is not limited in this respect.

The foregoing and other aspects, embodiments, and features of the present teachings can be more fully understood from the following description in conjunction with the accompanying drawings.

BRIEF DESCRIPTION OF DRAWINGS

The accompanying drawings are not intended to be drawn to scale. In the drawings, each identical or nearly identical component that is illustrated in various figures is represented by a like numeral. For purposes of clarity, not every component may be labeled in every drawing. In the drawings.

DETAILED DESCRIPTION

Floor treatment appliances are used to clean and treat floors in the home, office, and other locations. Various types of surface treatment appliances are known, including floor treatment appliances having a body that pivots and swivels relative to an appliance head. This combination of pivoting and swiveling allows a user to steer the appliance along a floor surface by twisting the appliance handle.

The ability to stabilize a floor treatment appliance by locking the forward/backward tilt is helpful for storing the appliance. In some appliances, the locking of forward/backward tilt occurs automatically such that bringing the body of the appliance to an upright or forward position causes a pivot lock to engage. Before being able to use the appliance again, the user disengages the lock to tilt the appliance. The lock may be disengaged with a mechanical trigger such as a foot pedal, or in some cases simply by pulling on the body.

One issue with providing a tilt locking mechanism on a pivoting and swiveling appliance is that when steering the appliance, a lower portion of the body may be pivoted all the way forward while an upper portion of the body is swiveled. If the lower portion of the body locks in this forward position while the upper body is swiveled, steering is interrupted and the user may have to disengage the tilt lock to continue using the appliance.

Another issue associated with a tilt locking mechanism may occur when the user is trying to store the device in an upright position. If the upper body is allowed to be swiveled away from center when locking the tilt of the lower body portion, the body may tip over sideways when the user lets go of the handle. Or the user might be required to make several attempts at centering the swivel of the body when locking the forward/backward tilt, unlocking the tilt lock each time. To address these issues, some embodiments disclosed herein prevent an appliance body from having forward/backward pivoting become locked when the body is swiveled.

Another issue with pivoting and swiveling appliances is preventing the body from swiveling when the tilt of the body is locked in a storage position. The body may fall over or be difficult to store if the swivel is not stabilized. To address this issue, embodiments disclosed herein prevent the body from swiveling when the tilt of the body is locked in a storage position.

Many floor treatment appliances include automatic shut off mechanisms when the appliance is brought to an upright storage position. In some appliances, a portion of the body can be brought to a forward position while another portion of the body is swiveled. It would be undesirable for the appliance to automatically shut off during use in response to the lower body portion being in the forward position, but with the upper body in a swiveled position. Aspects of the disclosure herein prevent the appliance from automatically shutting off while the body is in the swiveled position.

Figure 1:
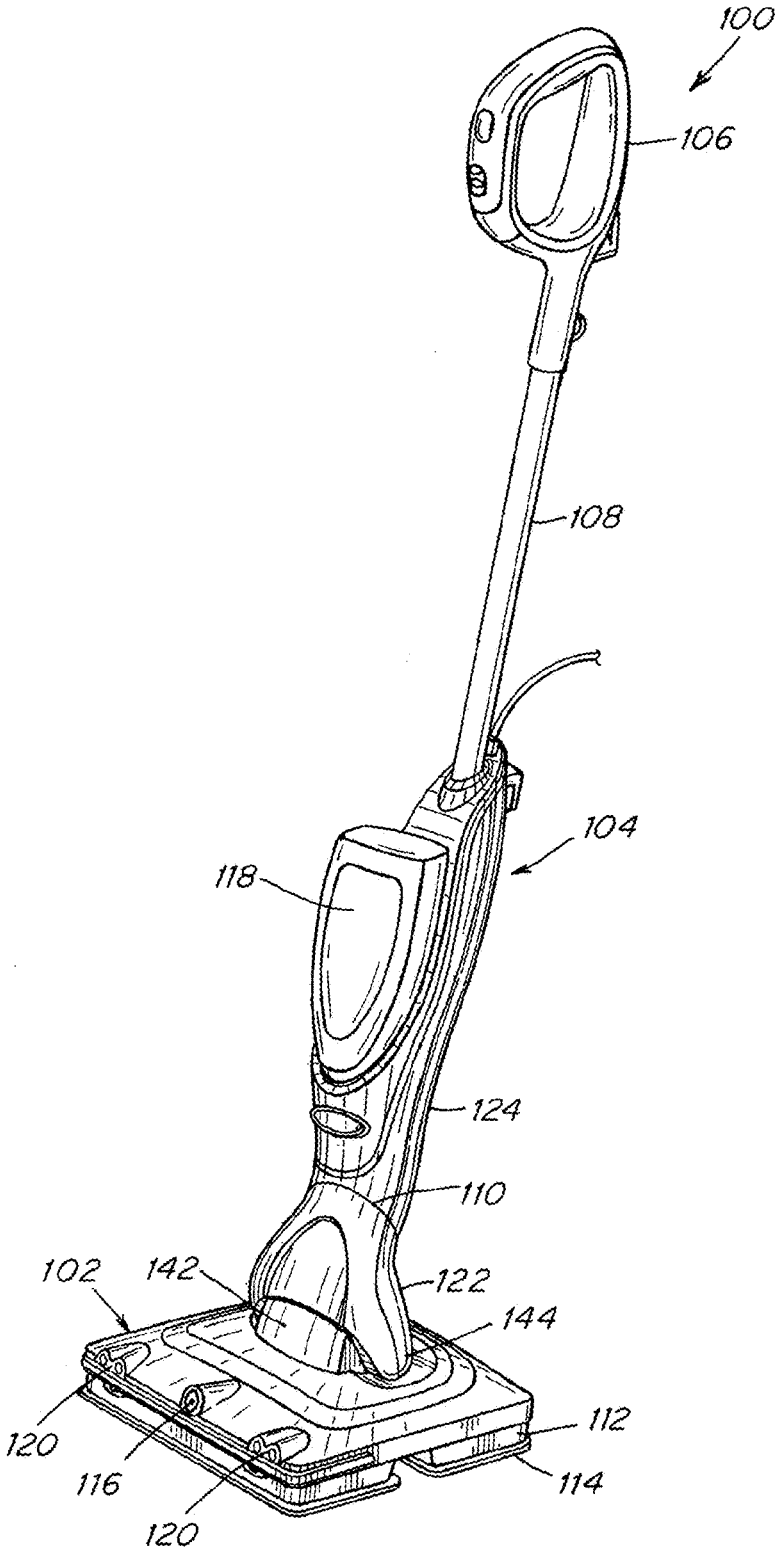
FIG. 1 is a perspective view of a floor treatment appliance according to one embodiment.
Figure 2:
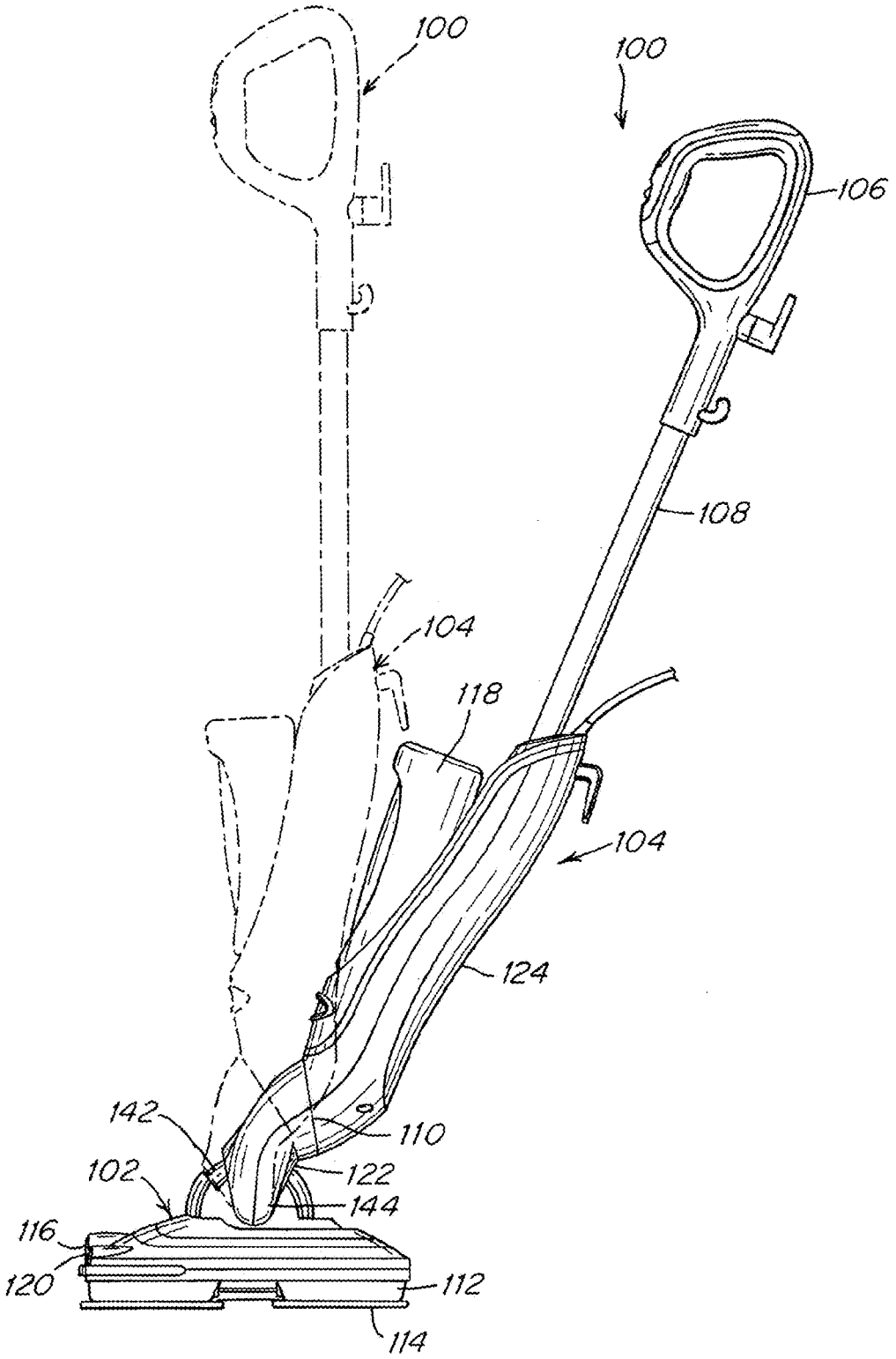
FIG. 2 is side view of the floor treatment appliance of FIG. 1 shown in a use position (solid lines) and a storage position (dashed lines)

Turning now to the figures, FIG. 1 shows a floor treatment appliance 100 according to one embodiment, in which the appliance 100 includes an appliance head 102 and a body 104 pivotally connected to the appliance head. The pivotable connection allows the body to tilt forward and backward relative to the appliance head when used to treat a floor surface. A user also may lock the body relative to the appliance head in a storage position. FIG. 2 illustrates the body in the storage position (dashed lines), and in the use position (solid lines), according to one embodiment. The body may be in the storage position when the body is brought fully forward and to an upright position; however, the body need not be in a fully upright position to be in a storage position in some embodiments, but may be in any desirable position convenient for storing. The body may pivot any suitable amount and is not limited to pivoting in only one direction from the storage position.

According to one embodiment, the floor treatment appliance 100 is a reciprocating cleaning appliance. In such an embodiment, the appliance head 102 includes one or more moveable cleaning members 112 to which a surface treatment pad 114 may be attached. The moveable members are powered by an electric motor and move linearly back and forth across the floor. The moveable members may move toward and away from each other in some embodiments, or in the same direction in some embodiments. The appliance head may further include a liquid applicator 116 that sprays or otherwise applies cleaning liquid stored in a liquid reservoir 118. Although the embodiments described herein include a reciprocating cleaning appliance, it should be appreciated that floor treatment appliances incorporating aspects of the present disclosure may include any floor treatment appliances (e.g., vacuum cleaners, steam mops, static mops, dusters, floor polishers, or other appliances).

Figure 6:
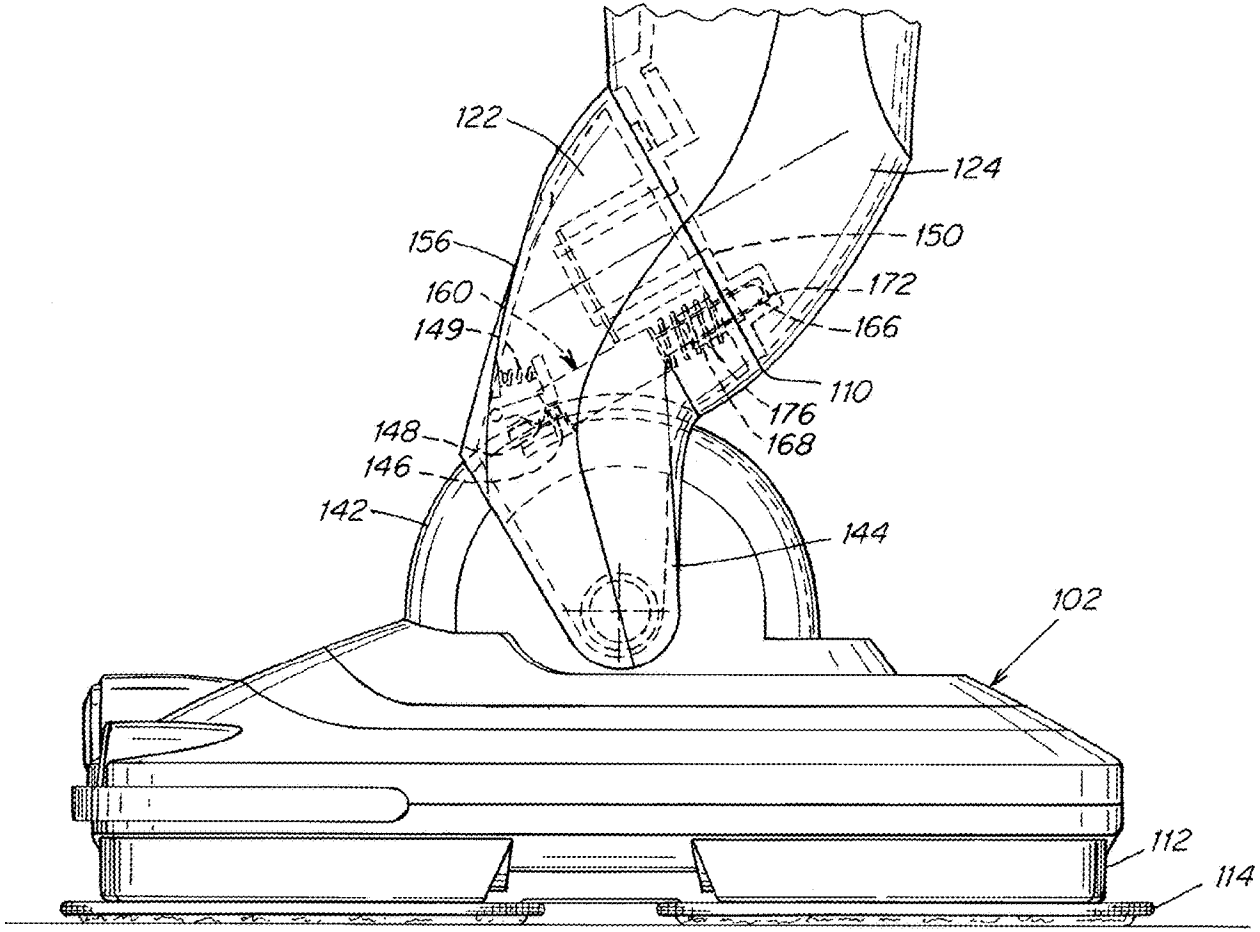
FIG. 6 is a side view of a swivel assembly according to one embodiment with the floor treatment appliance in a home swivel position.

According to one embodiment, the body 104 may include a handle 106 connected to the body by a body extension 108. The body 104 may further include a swivel joint 110 that allows a portion of the body to swivel relative to the appliance head 102. The swivel joint 110 may include a swivel disk 150, as shown in FIG. 6, forming a rotating connection between a lower portion 122 of the body and an upper portion 124 of the body.

The body 104 may have at least two positions: a home swivel position and a non-home swivel position. In the home swivel position, the body may be in a centered position; however, the home position need not be centered, but may be in any position that allows the appliance to be brought to a storage position for convenient storing. In the non-home swivel position, the body 104 may be swiveled any number of degrees in either direction from the home swivel position, or, in some embodiments the body may swivel in one direction from the home swivel position. The swivel disk 150 may include a biasing device to bias the body into a home swivel position. For purposes herein, references to the body being in a "swiveled position" mean that the body 104 is in a position other than the home swivel position.

The combination of the pivotable connection and the swivel joint 110 allows a user to steer the floor treatment appliance by twisting the handle 106. When the body 104 is tilted and the user rotates the handle 106 by twisting his or her wrist, the body axially rotates about its longitudinal axis, causing the appliance head 102 to turn. Other than its rotation about its longitudinal axis, the body 104 may remain substantially stationary while the appliance head 102 turns.

Figure 4:
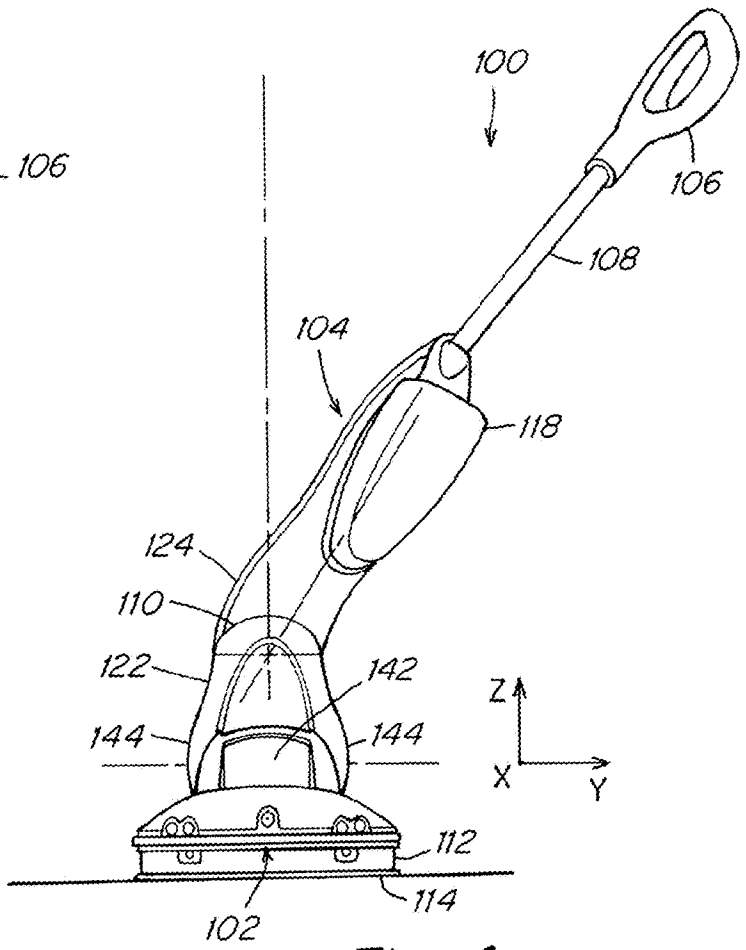
FIG. 4 is a front view of the floor treatment appliance of FIG. 1 shown in a use position and in a non-home swivel position.
Figure 3:
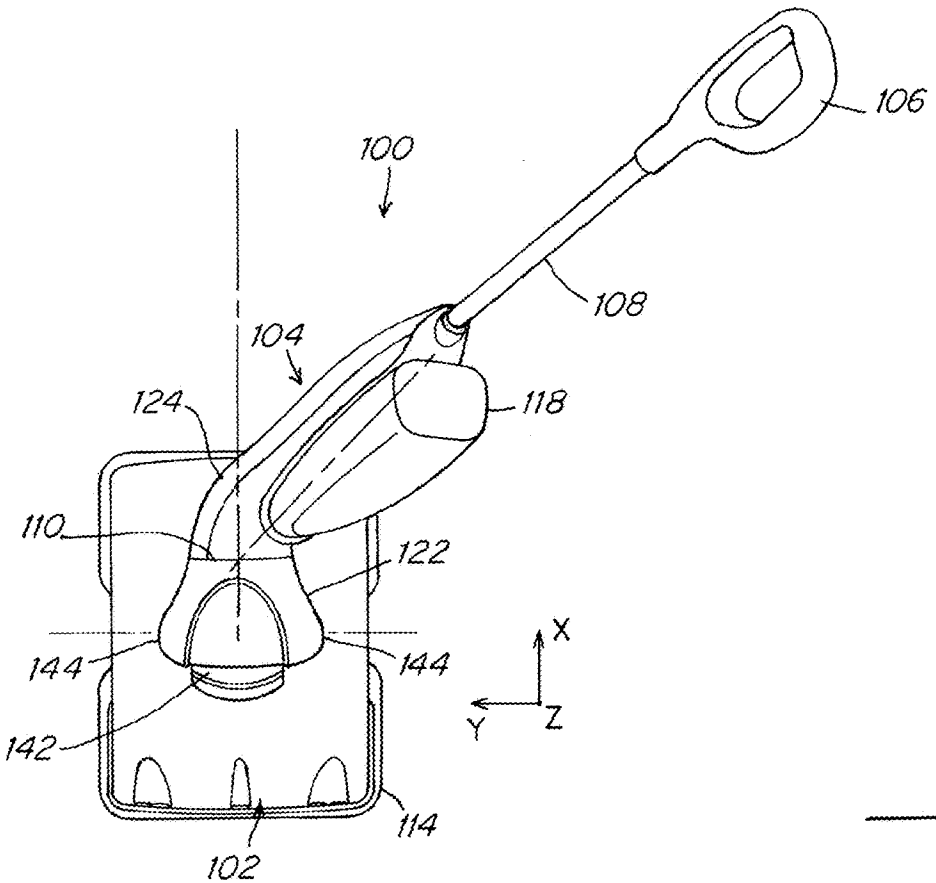
FIG. 3 is a top view of the floor treatment appliance in the same position as FIG. 3.
Figure 5:
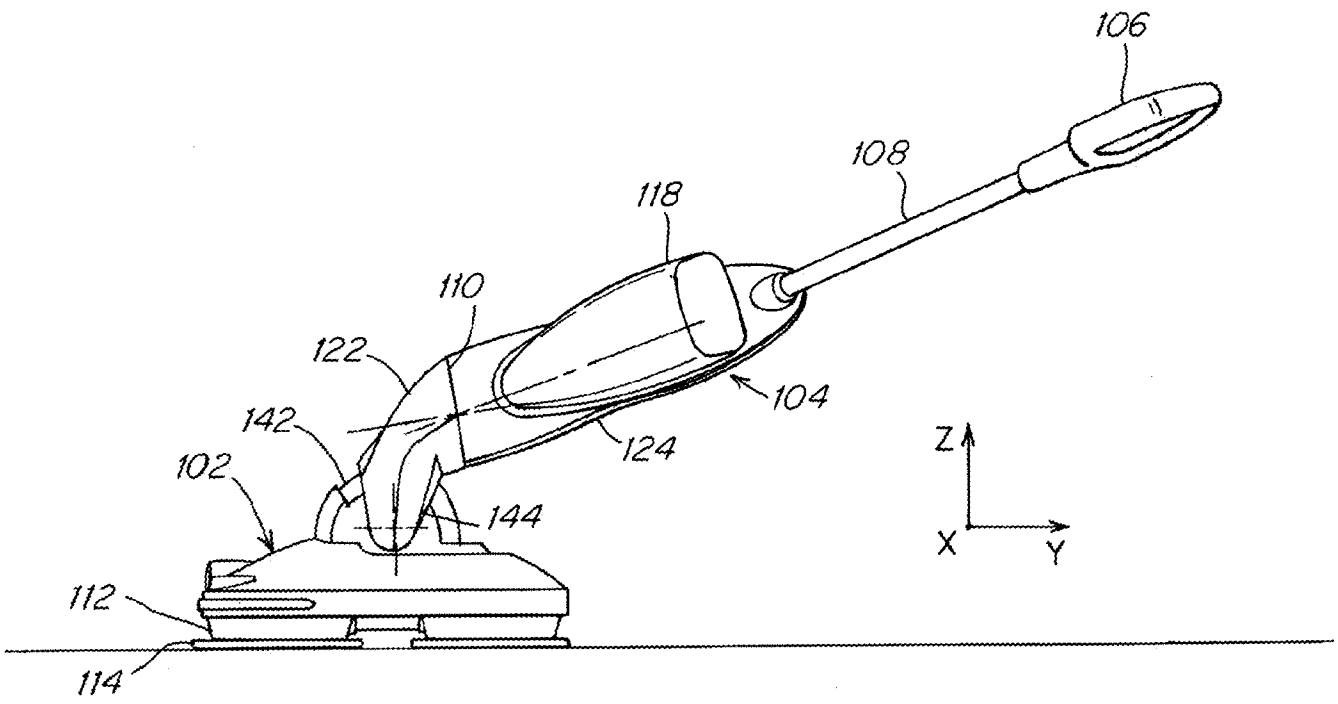
FIG. 5 is a side view of the floor treatment appliance of FIG. 1 shown in a use position and in a non-home swivel position.

FIGS. 3 through 5 show the body 104 in a swiveled position according to one embodiment. FIG. 5 illustrates that steering the appliance may swivel the body while bringing the tilt of the lower body portion to a forward position. A lock prevention member 160, described in detail below, prevents the body lower portion 122 from being brought to a fully forward locking position when the body is swiveled. In other words, the lock-prevention member 160 requires that the upper body be in the home swivel position for the lower body to be permitted to be brought to the tilt locking position. As a result, a user will not inadvertently pivotally lock the body while steering the appliance.

According to one embodiment, the lower portion 122 of the body is yoke-shaped, as shown in FIG. 4, and each extending end 144 of the yoke is pivotally connected to the appliance head 102. The appliance head may have a rounded portion 142, with the yoke-shaped body being configured to clear the rounded portion as the body pivots relative to the appliance head. The rounded portion may house a motor for driving the moveable cleaning members 112. Although a yoke-shaped body is disclosed, one of skill in the art would appreciate that the lower portion of body may be any suitable shape.

Figures 7, 7A:
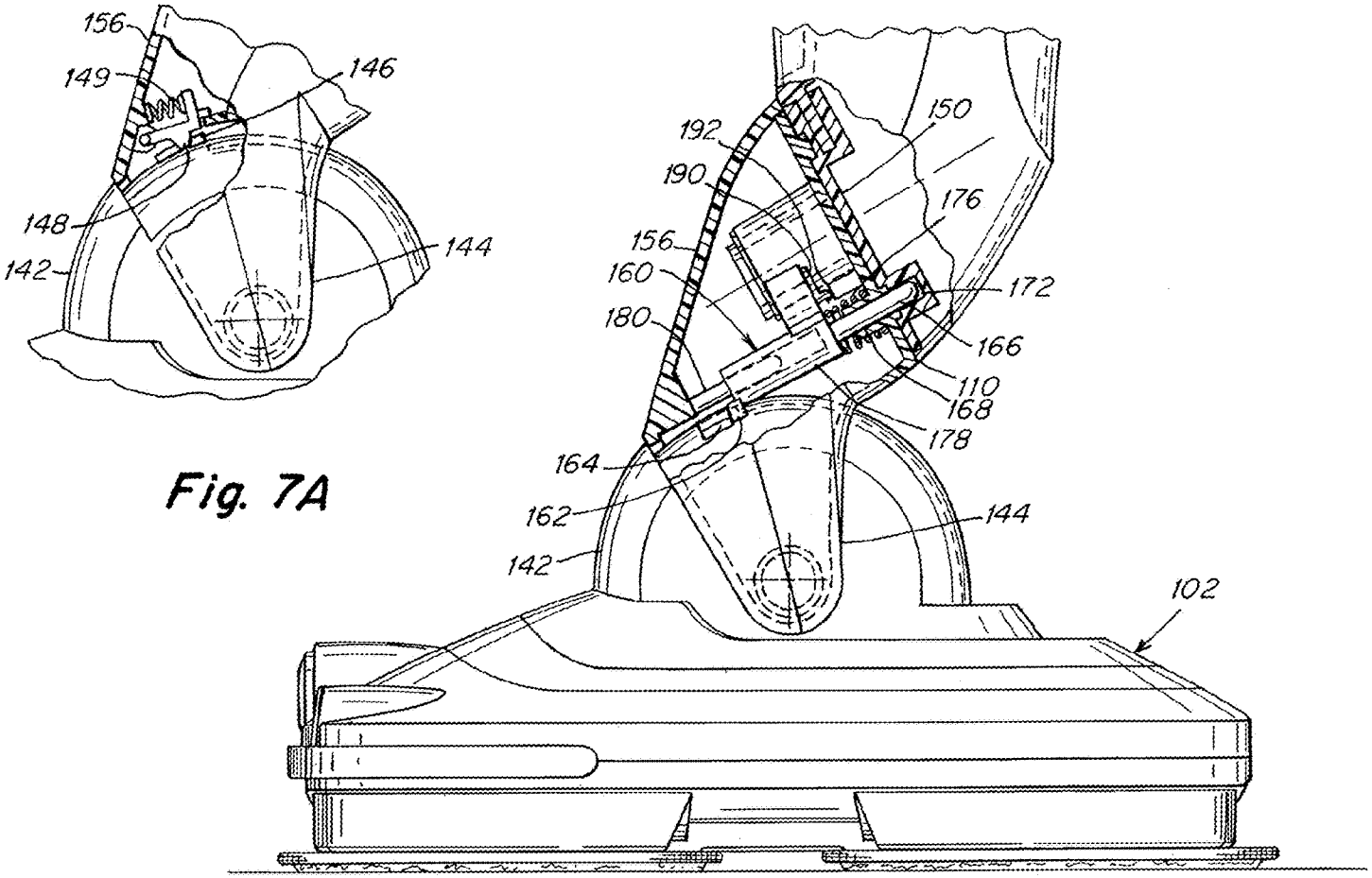
FIG. 7 is a side view of the swivel assembly of FIG. 6 with the floor treatment appliance in a storage position.
FIG. 7A is a side view of a locking arrangement of the floor treatment appliance of FIG. 1 with the floor treatment appliance in a storage position.

FIGS. 6 and 7*a* illustrate a locking device for locking the tilt of the body 104 according to one embodiment. The appliance head includes a first locking member 146 configured to engage a second locking member 148 on a portion of the body 104. When the user brings the body to the storage position, the locking members engage to pivotally lock the body. The user may release the locking members from each other simply by pulling rearwardly on the handle while stepping on the appliance head.

Figure 8:
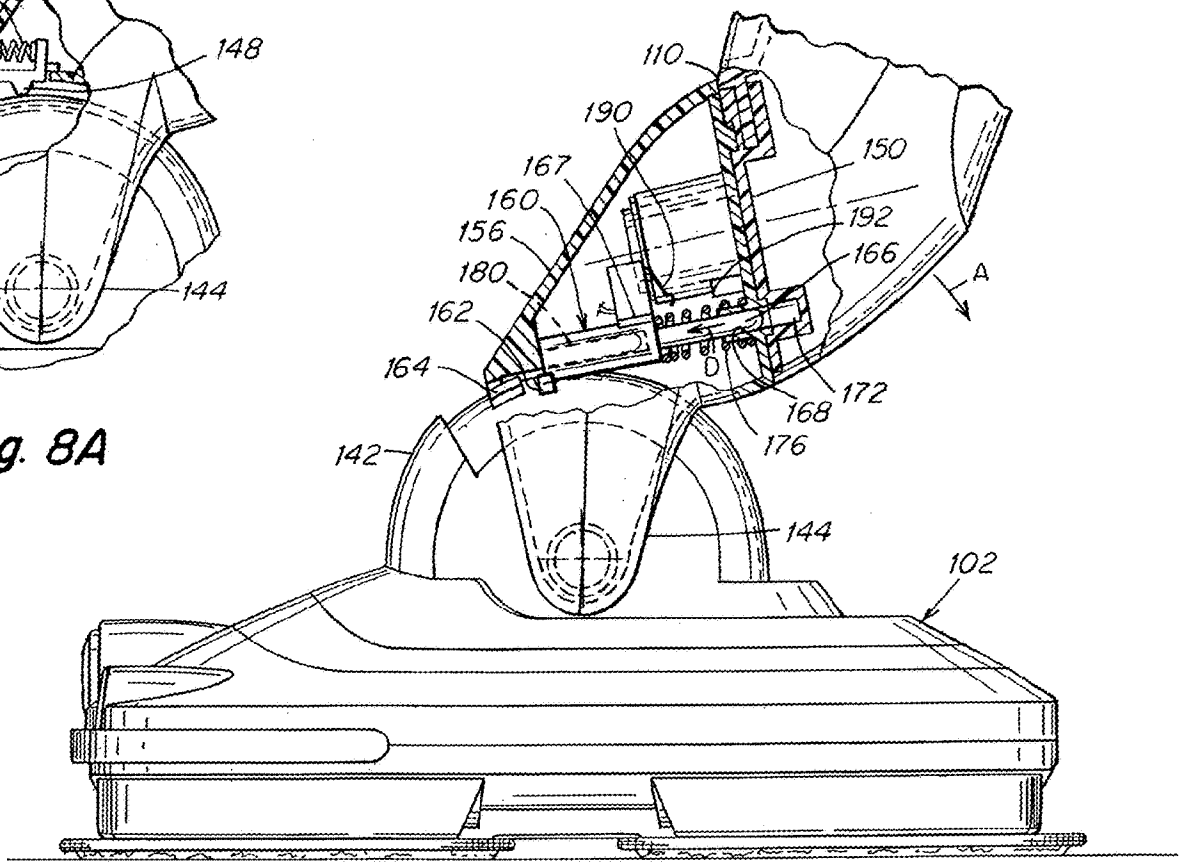
FIG. 8 is a side view of the swivel assembly of FIG. 6 with the floor treatment appliance in a use position.
Figure 8A:
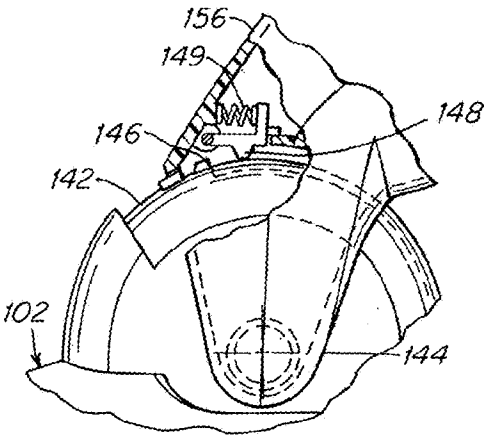
FIG. 8A is a side view of a locking arrangement of the floor treatment appliance of FIG. 1 with the floor treatment appliance in a use position.

In the embodiment shown, the first locking member 146 is a protrusion on the rounded portion of the appliance head, and the second locking member 148 is a spring-biased catch arranged in the body to pivot with the body over the rounded portion of the appliance head. The protrusion is arranged on the appliance head such that when the body is brought forward toward the upright storage position, the spring-biased catch passes over the protrusion and is pressed downwardly by a spring 149 upon reaching the opposite side of the protrusion, as shown in FIG. 7A. Although described herein as a lock, the locking arrangement does not permanently lock the body, nor does the locking arrangement necessarily include a component that the user has to separately move relative to the body or appliance head before pulling on the handle. For example, to unlock the body from the upright storage position, the user may pull the body backwards in the direction of arrow A of FIG. 8, exerting sufficient force to compress the spring 149 and push the catch away from the appliance head to release the catch from the protrusion, as shown in FIGS. 8 and 8A. One of skill in the art will appreciate that other locking arrangements may be used, such as a magnetic lock, an interference lock, or any other type of suitable lock arrangement.

According to one embodiment, the body may include a moveable lock-prevention member 160 that prevents pivotal locking of the lower body portion in the storage position when the upper body portion is swiveled, as shown in FIGS. 7 through 11. In this embodiment, the storage position is an upright storage position and the body pivotally locks when the body is brought fully forward to the upright position. The lock-prevention member pivots with the body 104, moving relative to the appliance head. The lock-prevention member is slidable linearly between the swivel joint 110 and a front portion of the body 156, moving relative to the body 104. A portion of the lock-prevention member contacts a portion of the appliance head 102 when the lower body is brought forward toward the storage position with the upper body in the non-home swivel position. More specifically, a blocker 162 contacts a projection 164 on the appliance head, which prevents the spring-biased catch 148 from reaching the protrusion 146, thereby preventing the lower body from locking in the storage position.

When the body is in the home swivel position, the lock-prevention member 160 is allowed to slide rearwardly within the body such that the blocker(s) do not prevent the body from reaching the fully forward position. Accordingly, when the body is in the home swivel position, the body may be brought sufficiently forward for the locking members 146, 148 to engage with one another, thereby pivotally locking the body.

Figure 9:
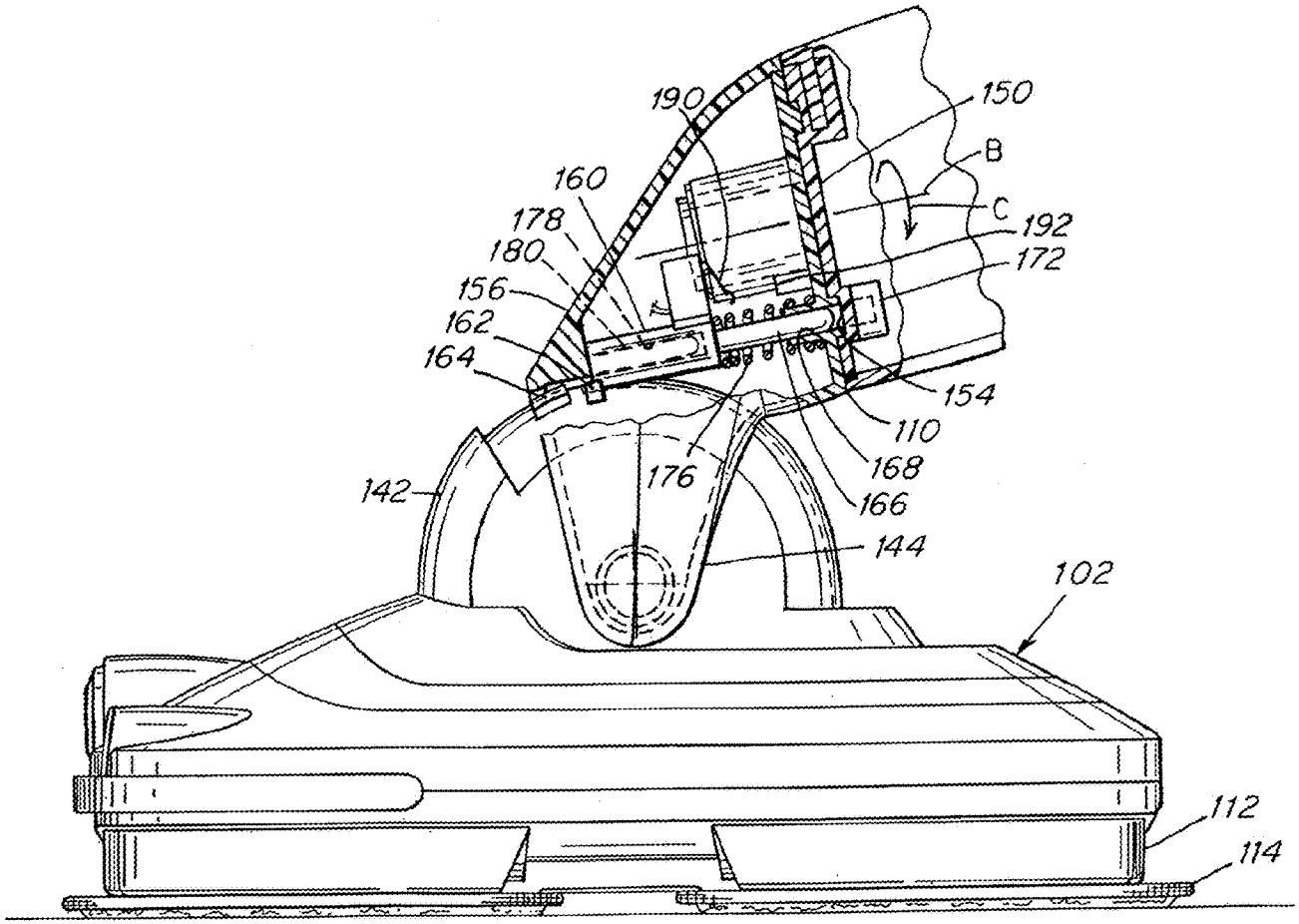
FIG. 9 is a side view of the swivel assembly of FIG. 6 with the floor treatment appliance in a use position and in a non-home swivel position.
Figure 10:
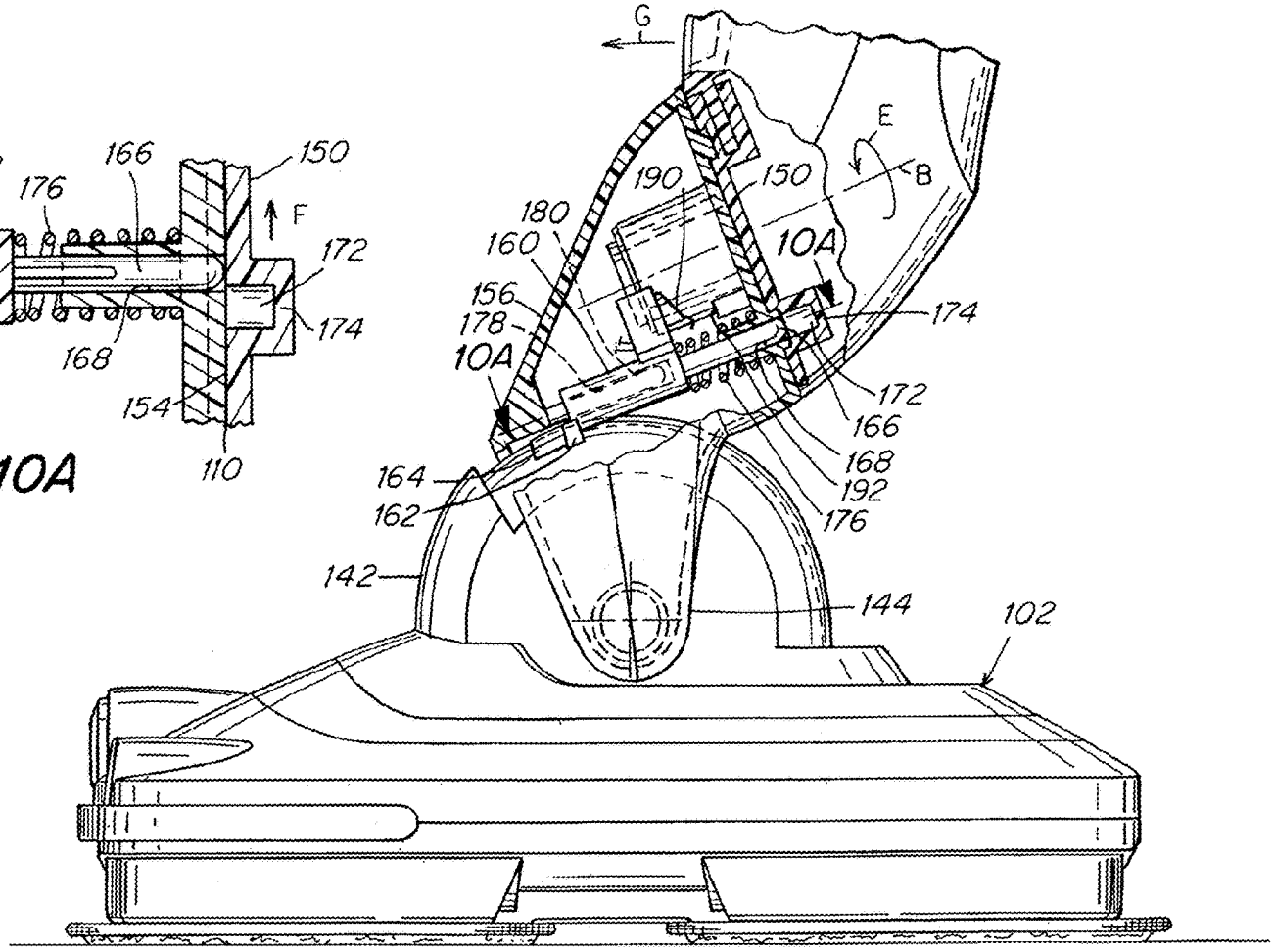
FIG. 10 is a side view of the swivel assembly of FIG. 6 when the floor treatment appliance is brought from a non-home swivel position to a home swivel position.
Figure 10A:
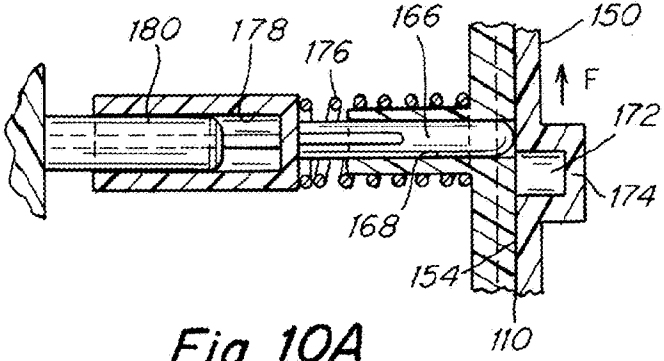
FIG. 10A is an enlarged side view of a moveable lock-prevention member according to one embodiment when the floor treatment appliance is brought from a non-home swivel position to a home swivel position.
Figure 11:
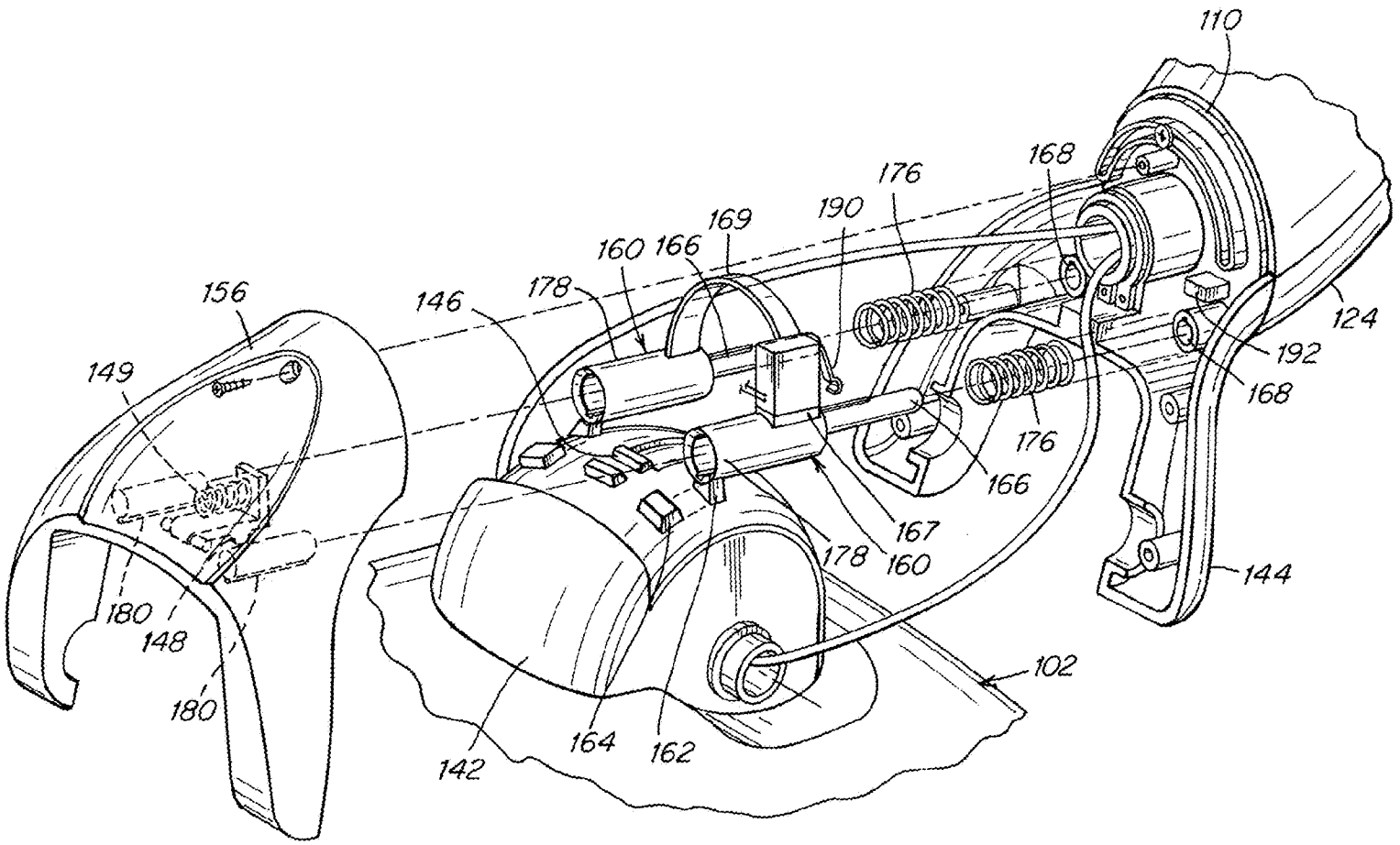
FIG. 11 is an exploded perspective view of the swivel and lock assembly of FIG. 6.

According to one embodiment, the lock-prevention member 160 may be a pin assembly having one or more extending pins 166, as shown in FIGS. 6 through 12. In a pin assembly having more than one pin, the pins may be connected by connecting member, such as an arch 169, as shown in FIG. 11, or other member, or they may not be directly connected to each other. The pins may slide linearly in a direction perpendicular to the swivel joint 110 in channels 168 located in the body at the swivel joint 110. The channels may extend into the swivel joint 110 such that the end of the channel contacts a surface of the swivel disk 150, as shown in FIG. 10A. Opposite the extension pins, the pin assembly may include hollow channels 178 which slide on extensions 180 in the front portion of the body. Alternatively, the pin assembly may include one pin or channel that slides with respect to channels or pins located at the swivel joint and in the front portion of the body. The pins and channels may be cylindrical or any other suitable shape.

When the floor treatment appliance is in the storage position, the blockers 162 of the pin assembly are pushed against the protrusion 164 on the appliance head, as shown in FIG. 7. As a result, the pins 166 of the pin assembly are pushed into channel extensions 172 (or other openings) in the swivel disk. With the pins in the channel extensions of the swivel disk, the swivel disk is prevented from swiveling. In this manner, the upper body is prevented from swiveling.

When the body is in the swiveled position, as illustrated in FIGS. 9 and 10A, the channel extensions 172 do not align with the pins 166 of the lock-prevention member 160, and therefore the pins contact a surface of the swivel disk 150, preventing rearward movement of the lock-prevention member. FIG. 9 illustrates the lock-prevention member when the body is swiveled counter-clockwise in the direction of arrow C about axis B. The lock-prevention member is dimensioned such that when the body is swiveled, the pin 166 abuts a lower surface 154 of the swivel disk causing the blocker 162 to contact the projection 164 on the appliance head 102 before the lower body reaches the storage position. Accordingly, when the upper body is swiveled, the lower body is prevented from being brought sufficiently forward to allow the locking members 146, 148 to engage and pivotally lock the body.

FIGS. 9, 10 and 10A illustrate the body swiveling from the non-home swivel position (FIGS. 9 and 10A) to the home swivel position (FIG. 10). When the body rotates, the swivel disk may rotate with the body such that channel extension 172 rotates as well. According to one embodiment, when the body rotates about axis B in the direction of arrow E from the non-home swiveled position of FIG. 9 back to the home swiveled position of FIG. 10, the channel extensions 172 will move in the direction of arrow F of FIG. 10A to align with the channel 168. When the body is in the home swivel position, the channel extension aligns with the channel 168 to allow the pin 166 to extend into the channel extension. According to one embodiment, the channel extension 172 has an end wall 174, but the opening also may be a through hole in some embodiments. As a result of the pins 166 being permitted to enter the channel extensions 172, the body may then be able to be brought sufficiently forward in the direction of arrow G to allow the locking members 146, 148 to engage and lock the body in the storage position.

As mentioned above, the floor treatment appliance may include a moveable swivel-prevention member that prevents the body from swiveling when pivotally locked. In some embodiments, the swivel-prevention member locks the swivel whenever the body is brought to the storage position, and the storage position is when the body is in a fully forward pivot position.

In some embodiments, the swivel prevention member is part of the lock-prevention member 160 described above. When the body is brought to the storage position, the pin assembly contacts a portion of the appliance head which forces the pin 166 (or pins) into an opening in the swivel disk, for example channel extension 172. As shown in FIG. 7, the pin(s) act to secure the swivel disk 150 against rotation, thereby preventing the body from swiveling. In an alternative embodiment, the swivel-prevention member may be arranged as part of the appliance head which engages the swivel disk 150 when the body is brought to the storage position.

Figure 12:
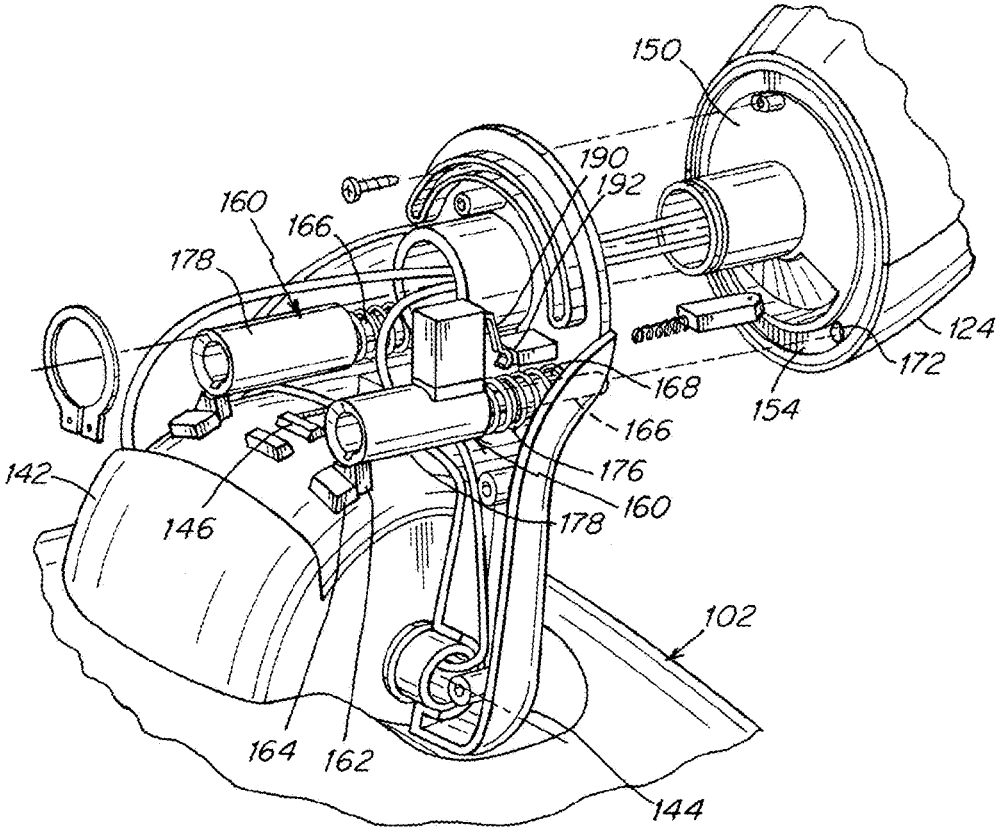
FIG. 12 is an exploded perspective view of a swivel joint according to one embodiment.

The swivel-prevention member may be biased to move the pin 166 out of the channel extensions 172 when the body 104 is in the use position. In one embodiment, as shown in FIGS. 8, 11 and 12, a spring 176 may be included on the pin 166 to force the pin out of the channel extensions when the body is pivoted in the direction of arrow A, causing the pins to move in the direction of arrow D.

In some embodiments, as shown in FIG. 8, the floor treatment appliance includes a switch 190 or other sensor component to power down at least a portion of the appliance when the body is brought to the storage position. As previously discussed, during use, the lower portion of the appliance may be brought fully forward, or nearly fully forward, while the upper portion of the body is swiveled relative to the lower portion. Bringing the lower portion forward may cause the appliance to shut off while the appliance is being used. To prevent powering off the appliance during use, embodiments disclosed herein include a switch or other sensor that is not activated when the body is swiveled.

In one embodiment, the switch may be located on the appliance head or it may be located in the body. In one embodiment, the switch 190 is a normally open, spring-biased switch located on an extension 167 of the lock-prevention member, as shown in FIG. 11. The extension 167 may be formed as part of the arch 169. When the switch is pushed into a closed state, a controller is signaled to turn off the appliance. The switch may travel on the lock-prevention member and when the body is pivoted fully forward, the switch may be pressed against a surface and become closed. To prevent activation of the switch when the body is swiveled, the lock prevention member may be arranged such that the switch cannot move all the way to the contact surface when the body is swiveled.

For example, FIGS. 8-12 illustrate the switch 190 on the pin assembly in the normally open position. When the body is in a non-home swiveled position, as in FIG. 8, the pins contact a surface of the swivel disk and prevent the switch from contacting a surface 192. When the body is the home swivel position, however, as shown in FIG. 7, the pins may extend through the channel extensions 172, allowing the switch to be pressed against the contact surface 192. The particular manner of mounting the switch is not intended to be limiting.

Instead of a normally open, spring-biased switch, any suitable type of sensor may be used to trigger shut down of the appliance or portion thereof. For example, an optical sensor may be used to sense when a portion of the appliance body is brought to a fully forward position with the body in a non-swiveled position.

Figure 13:
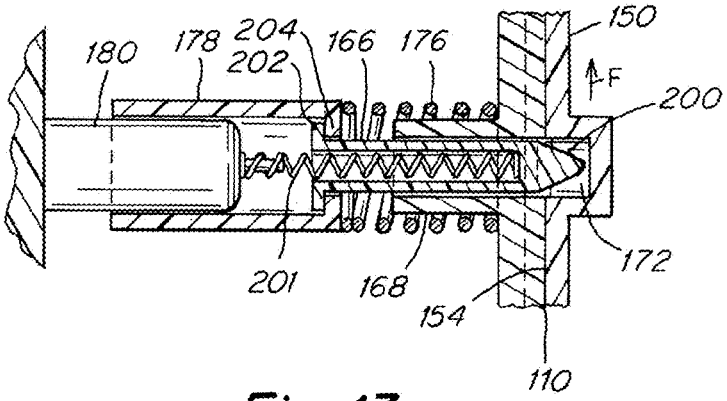
FIG. 13 is an enlarged side view of a moveable lock-prevention member according to one embodiment when the floor treatment appliance is brought from a non-home swivel position to a home swivel position.

In some embodiments, the upright locking mechanism for the swivel may be releasable under loading when the body is in the home and upright locked position to prevent breakage. Such breakage may occur, for example, if the product fails. As shown in FIG. 13, in some embodiments, the pins 166 are moveable relative to hollow channels 178 and are biased by a spring 201 such that in a normal position an arm 202 is pressed against the shoulder 204. An end 200 of the pins 166 may be a wedge shape, such that the pins 166 are driven out of the channel extensions 172 of the swivel disk 150 and are forced in the direction of extension 180 if a large force is applied in direction F. In this manner, the upper body can be both locked in the home position and releasable under certain conditions in some embodiments. In some embodiments, the spring force of spring 201 is sufficient to prevent pivot latching when the swivel 150 is in the non-home position, as it does when the pins 166 and the hollow channels 178 are connected. In some embodiments, as shown in FIG. 1, the appliance head 102 may have one or more lights 120 or other illumination device to illuminate the cleaning fluid spray and the floor surface in front of the treatment appliance 100. The lights 120 may be LED lights which are aimed to illuminate the cleaning fluid as it travels from the applicator to the floor to provide feedback to the user that the fluid is being applied. For example, instead of being aimed straight ahead, lights 120 may be angled inwardly.

Having thus described several aspects of at least one embodiment of this invention, it is to be appreciated that various alterations, modifications, and improvements will readily occur to those skilled in the art. Such alterations, modifications, and improvements are intended to be part of this disclosure, and are intended to be within the spirit and scope of the invention. Accordingly, the foregoing description and drawings are by way of example only.

What is claimed is:

1. A floor treatment appliance comprising:

an appliance head to treat a floor surface;

a body having a lower body portion pivotally connected to the appliance head, the lower body portion being pivotable about a first axis between a use position and a locked position in which the body is pivotally lockable, the body including a swivel joint that allows an upper body portion of the body to swivel about a second axis transverse to the first axis relative to the appliance head between at least a home swivel position and a non-home swivel position; and a sensor component that prompts a stopping of operation of at least one powered component of the appliance when the body is brought to the locked position with the body in the home swivel position, wherein the sensor does not prompt a stopping of operation of the at least one powered component of the appliance when the body is pivoted as far forward as possible with the body in the non-home swivel position.

2. A floor treatment appliance as in claim 1, wherein the sensor is arranged on the appliance head.

3. A floor treatment appliance as in claim 1, wherein the sensor is arranged in the body on a moveable member that moves relative to the upper body portion of the body that swivels relative to the appliance head and moves relative to the appliance head.

4. A floor treatment appliance as in claim 3, wherein the moveable member prevents the body from reaching the locked position when the body is in the non-home swivel position.

5. A floor treatment appliance as in claim 3, wherein the moveable member comprises a blocker positioned to contact the appliance head to prevent the body from reaching the locked position when the body is in the non-home swivel position.

6. A floor treatment appliance as in claim 3, wherein the moveable member comprises a pin assembly.

7. A floor treatment appliance as in claim 6, wherein the pin assembly comprises at least two pins.

8. A floor treatment appliance as in claim 6, wherein the pin assembly comprises two parallel, connected pins.

9. A floor treatment appliance as in claim 3 wherein the body further comprises a swivel disk that rotates relative to the moveable member and wherein when the body is in the non-home swivel position, the swivel disk limits the distance which the moveable member can move relative to the body.

10. A floor treatment appliance as in claim 9, wherein the moveable member comprises at least two pins and wherein the swivel disk includes openings that align with the pins when the body is in the home swivel position to allow the pins to slide into the openings when the body is brought to the locked position.

11. A floor treatment appliance as in claim 10, wherein the moveable member includes a blocker positioned to contact the appliance head to move the pins into the openings when the body is brought to the locked position.

12. A floor treatment appliance as in claim 10, wherein the moveable member is biased to move the pins out of the openings when the body is in the use position.

13. A floor treatment appliance as in claim 1, further comprising a swivel-prevention member that prevents the body from swiveling when in the locked position.

14. A floor treatment appliance as in claim 13, wherein the swivel-prevention member locks the swivel joint when the body is in a pivotally locked position.

* * * * *